United States Patent [19]

Graham

[11] 4,131,058

[45] Dec. 26, 1978

[54] END TAB FOLDING MECHANISM FOR CARTONS

[75] Inventor: Robert H. Graham, Spokane, Wash.

[73] Assignee: R. A. Pearson Company, Spokane, Wash.

[21] Appl. No.: 839,884

[22] Filed: Oct. 6, 1977

[51] Int. Cl.[2] ..... B31B 1/26

[52] U.S. Cl. ..... 93/49 R; 53/374; 93/36 SQ

[58] Field of Search ..... 93/49 R, 36 SQ, 59 R, 93/84 R; 53/374

[56] References Cited

U.S. PATENT DOCUMENTS

| | | | |
|---|---|---|---|
| 1,974,165 | 9/1934 | Stage | 53/374 X |
| 2,927,411 | 3/1960 | Kerr | 53/374 X |
| 2,975,574 | 3/1961 | Jorgenson et al. | 53/374 X |
| 3,233,583 | 2/1966 | Neal et al. | 53/374 X |
| 3,421,415 | 1/1969 | Pearson | 93/49 R X |
| 3,452,514 | 7/1969 | Harkess | 93/49 R X |
| 3,466,843 | 9/1969 | Mumper | 53/374 X |
| 3,483,803 | 12/1969 | Bock et al. | 53/374 X |
| 3,755,333 | 8/1973 | Derderian et al. | 53/374 X |
| 3,973,375 | 8/1976 | Loveland | 53/374 |
| 4,066,068 | 1/1978 | Arvanigian | 93/49 R |

*Primary Examiner*—Leon Gilden

*Attorney, Agent, or Firm*—Wells, St. John & Roberts

[57] ABSTRACT

A mechanism for folding end tabs over and against the end walls of a partially completed carton. The mechanism is designed to handle cartons of two different lengths fed at random through the machine. It includes kicker elements to inwardly compress the carton and its contents so as to assure proper final carton formation when the end tabs are sealed. The end tabs are folded and sealed while the carton moves continuously along a longitudinal path. They are folded by transverse folding elements mounted across the working flight of an upper conveyor assembly along the carton path. Each tab is folded and sealed against the respective carton end walls as the carton progresses between the infeed and discharge ends of the conveyor assembly. Selected folding elements are activated dependent upon the length of a particular carton being handled.

11 Claims, 19 Drawing Figures

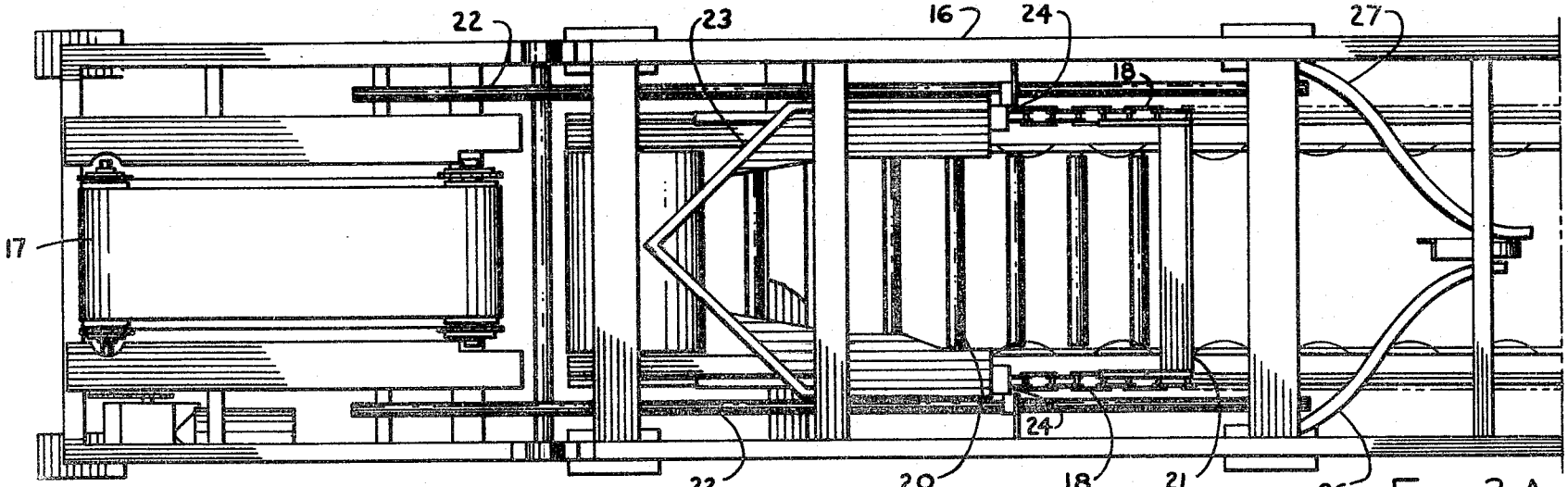
FIG. 3A
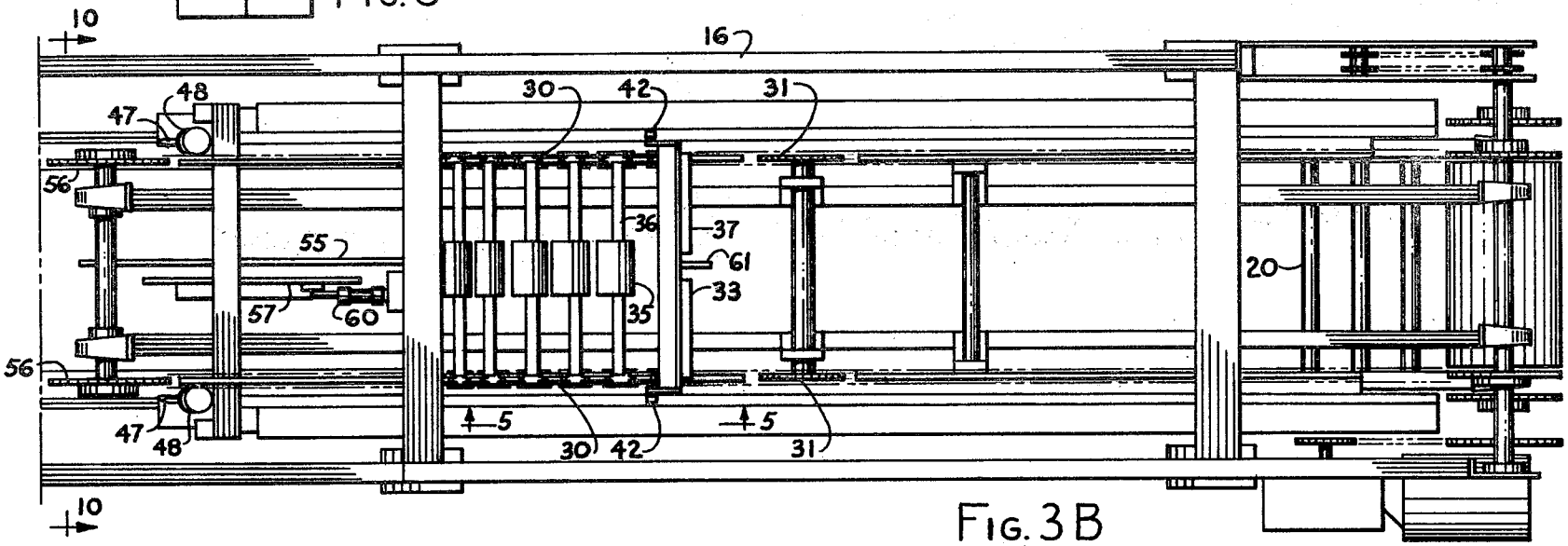
FIG. 3B
| 3A | 3B |
|---|---|
FIG. 3

| 4A | 4B |
|---|---|

END TAB FOLDING MECHANISM FOR CARTONS

BACKGROUND OF THE INVENTION

This invention relates to automated carton handling machinery. It is specifically designed for sealing the top and ends of cartons such as are used in the meat packing industry. These cartons are filled from the top. Each has a pair of top panels which overlap one another. Each panel in turn has a pair of outer tabs that must be folded and sealed to the exterior surfaces of the respective carton ends. The machinery has been designed for high speed operation, which requires that the top panels and end tabs be manipulated as each carton moves continuously along a selected path. The machinery has also been specifically designed to handle two different lengths of cartons fed at random through it.

The carton itself is fed into this mechanism in a partially folded condition. The bottom wall of the carton can be sealed by a machine such as that illustrated in U.S. Pat. No. 3,421,415, issued Jan. 14, 1969 entitled "Apparatus for Setting Up and Gluing Cartons". The precise manner by which the carton is prepared for loading and the manner by which it is loaded or filled are not material to an understanding of the present invention.

DESCRIPTION OF THE DRAWINGS

FIGS. 3, 3A and 3B constitute a plan view of the apparatus;

DESCRIPTION OF THE PREFERRED EMBODIMENT

Figure 1:
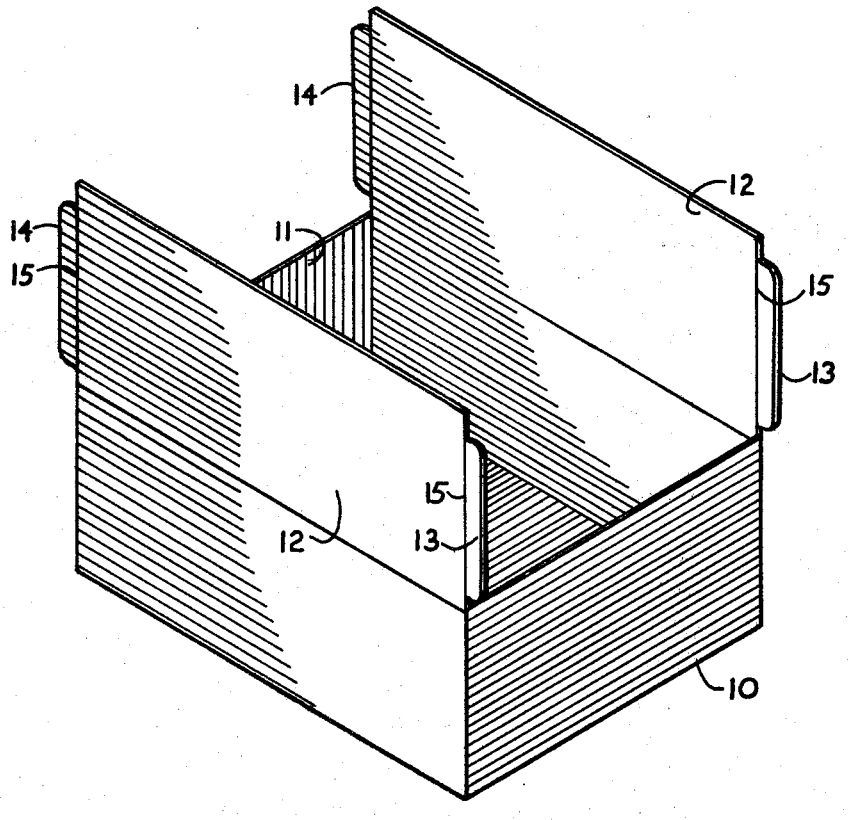
FIG. 1 is a perspective view of a partially folded carton.
Figure 2:
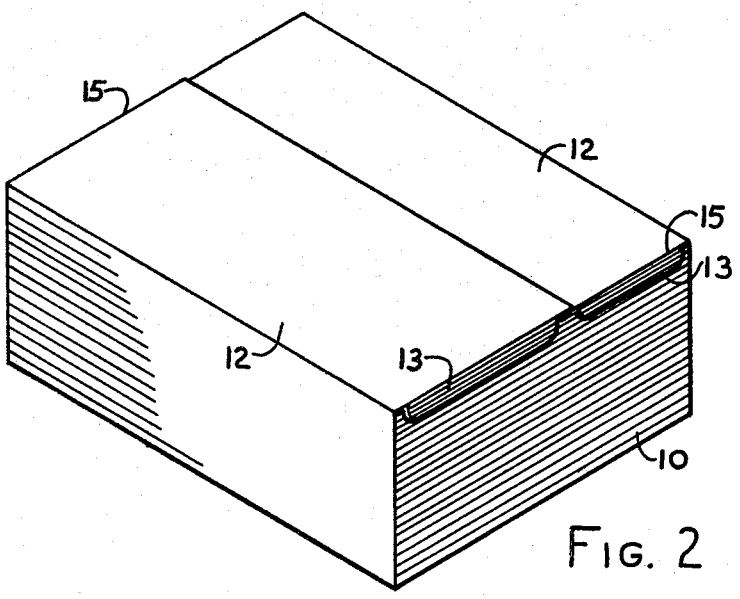
FIG. 2 is a perspective view of the sealed carton.

Referring to FIGS. 1 and 2, the carton with which this disclosure is concerned is generally rectangular in shape and typically manufactured of corrugated cardboard. The specific carton illustrated in FIGS. 1 and 2 is utilized in the meat packing industry. It is filled with meat for storage and transport purposes. Prior to loading of the carton, its walls and/or end walls are sealed by conventional available machinery (not shown). The carton is then fed to the present apparatus in a partially folded condition. The material filling the carton is not illustrated in the accompanying drawings, but it is fully loaded in actual usage.

The partially folded carton enters the apparatus in the condition shown in FIG. 1. It includes a front end wall 10 and a back end wall 11 which are longitudinally spaced from one another and are typically parallel vertical walls. They are joined by vertical longitudinal side walls and by the completed bottom wall of the carton. The upper edges of the end walls 10, 11 are open and extend in straight lines transversely across the carton width.

The top wall of the carton illustrated comprises two panels 12, each having a transverse width slightly greater than one half the width across the end walls 10, 11. They overlap along the longitudinal center line of the carton when folded to a closed condition substantially coplanar with one another. The top wall panels 12 might alternately comprise a single panel rather than the two panels illustrated. The panels 12 longitudinally overlap the separation between the upper edges of end walls 11, 12.

Each panel 12 has first and second foldable tabs 13, 14 formed integrally across it at the respective longitudinal ends thereof. The tabs 13, 14 overlie and project outwardly beyond the respective front and back end walls 10, 11 for foldable engagement against their exterior surfaces. The tabs 13, 14 are integrally joined to the top wall sections 12 along transverse fold lines indicated at 15.

Prior to sealing of the carton, conventional adhesive is applied to the inner surfaces of tabs 13, 14 and to the interior of the upper overlapping portions of the outer section 12.

Figures 4, 4A:
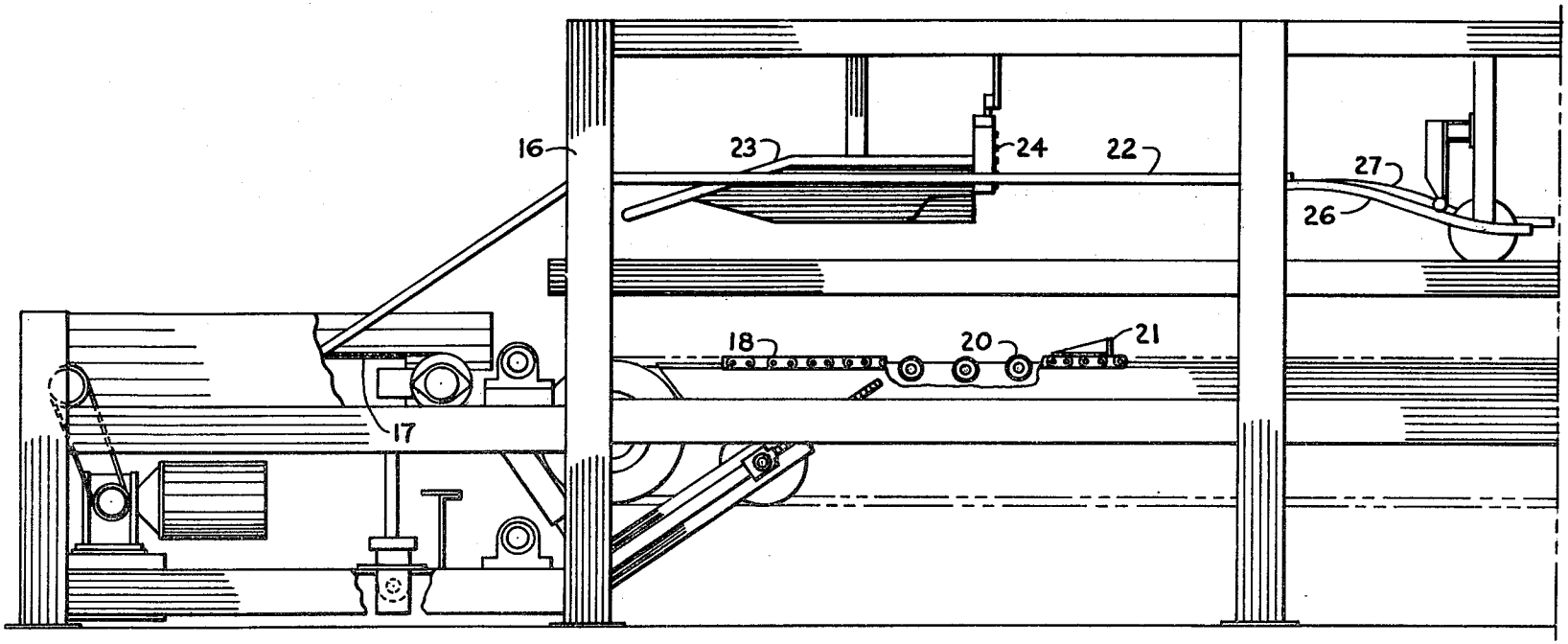
FIGS. 4A and 4B constitute is an elevation view.
Figure 4B:
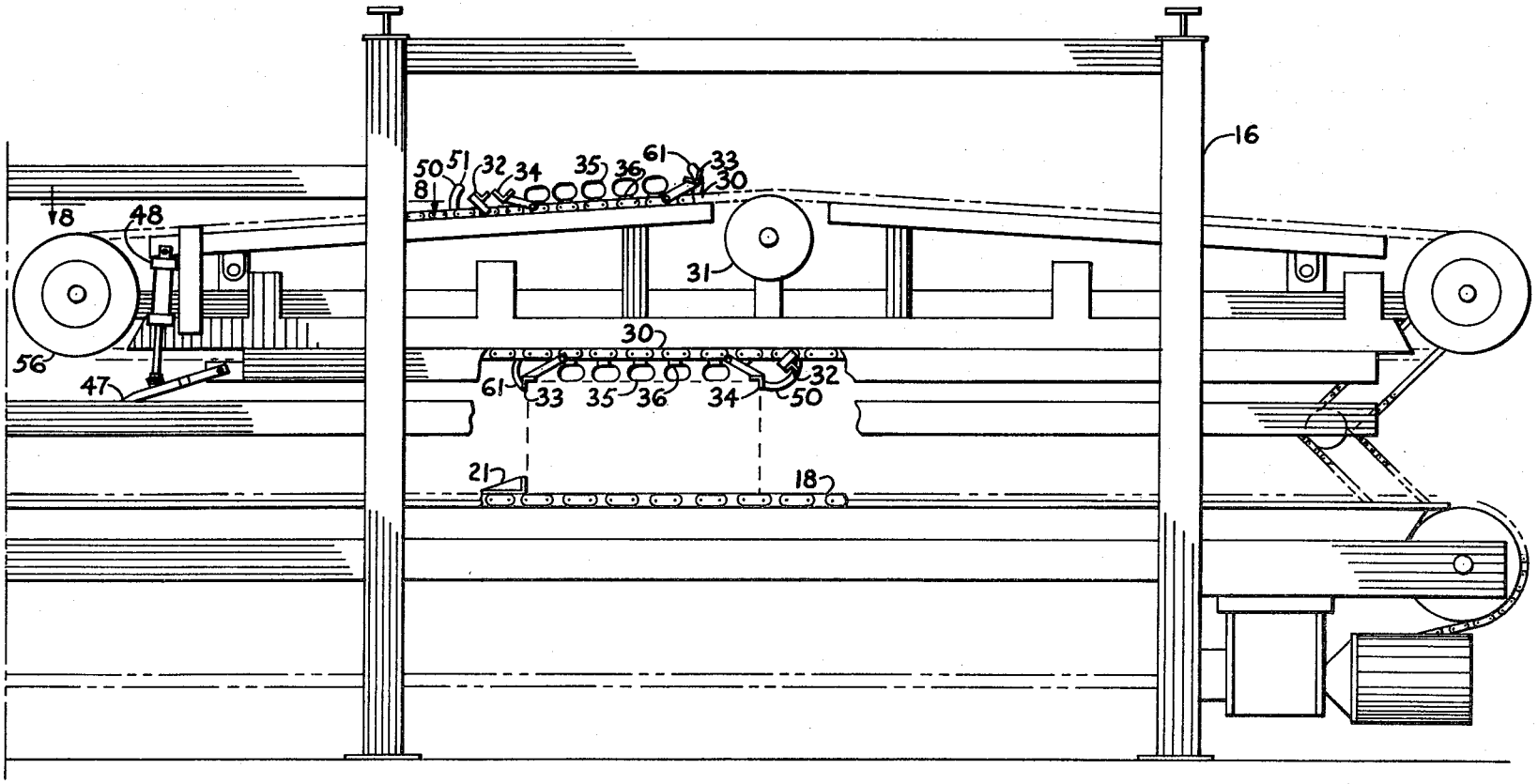

The general machine layout for sealing the top panels and end tabs can be viewed in FIGS. 3 and 4. While the present disclosure relates specifically to the mechanism for folding and sealing end tabs 13, 14, it is preferably designed and constructed in conjunction with an apparatus for sealing the top panels 12. A suitable arrangement for automatically sealing the panels 12 during continuous movement of the carton is shown in those portions of the drawings designated as FIGS. 3A and 4A. The mechanism for folding and sealing tabs 13, 14 is illustrated in those portions of the drawings designated as FIGS. 3B and 4B.

All of the mechanism shown in the drawings is mounted to a unitary rigid framework designated generally by the numeral 16. It is illustrated in the accompanying drawings as being rigid, but the conveyor widths and depths can readily be made adjustable or movable on the framework to accommodate cartons of various sizes.

The partially folded cartons are received at the left hand end of the machinery shown in FIGS. 3 and 4 on a short receiving conveyor belt 17. They are fed to the conveyor belt 17 from a loading mechanism which fills the carton in readiness for sealing of the top wall sections 12 and tabs 13, 14. The loading mechanism is not illustrated.

The conveyor belt 17 transfers each carton onto a central roller bed 20 comprising a series of parallel horizontal rollers. The rollers are not powered and are arranged transverse to the intended longitudinal direction of movement of the cartons along a continuous straight path. The cartons are pushed along the roller bed 20 by chain conveyors 18 at each side of the transverse rollers. Each chain conveyor 18 has a series of outwardly protruding pusher elements 21 in transversely aligned pairs arranged across the assembly. These elements 21 engage the back end wall of each carton to move it longitudinally from left to right as viewed in the drawings.

The top wall panels 12 of a loaded carton might have any of a variety of angular positions with respect to the side walls of the cartons. It is therefore necessary to provide means for folding each section 12 to a vertical position of adhesive application purposes. This is accomplished by longitudinal lifting rods 22 fixed to framework 16 alongside the chain conveyors 18 and by a central opening plow rod assembly 23 aligned along the longitudinal center of the roller bed 20. If the top panels 12 are bent outwardly from the carton, they will be folded to a vertical position by the lifting rods 22. If they are partially folded over the interior of the carton, they will be lifted by the plow rod assembly 23. The longitudinal extensions of these rods 22, 23 cooperatively assure that each top panel 12 is in a vertical position as the carton moves across conventional adhesive applicators 24 which apply a "hot melt" or other suitable adhesive to the carton surfaces in the general patterns described above.

After application of adhesive, the top panels 12 are engaged by closing plow rods 26, 27 which fold them over the carton to horizontal coplanar positions. Plow rod 26 leads rod 27 slightly to properly overlap the two panels 12. The overlapping portions of the panels 12 are then subjected to downward pressure by an idle roll 28 which compresses them in opposition to the load filling the carton.

The above apparatus is only exemplary of machinery for folding the top wall panels 12 and sealing them in preparation for engagement by the apparatus for folding the tabs 13, 14. Other machinery might be substituted, including machinery for accomplishing this result at a fixed station rather than during continuous movement of the carton. However, for high production facilities, continuous movement is desirable. This permits use of a single set of adhesive applicators 24 for applying adhesive to both the top wall panels 12 and tabs 13, 14.

After the sealing of top wall panels 12, each carton continues to be pushed through the machinery by the pusher elements 21. The cartons are then fed under an upper set of conveyor chains 30 having a horizontal working flight vertically adjacent to the sealed top wall sections 12 of each carton. The chains 30 are adjustably tightened by means of a central pair of vertically adjustable sprockets 31.

A plurality of sets of tab folders located along the conveyor chains 30 operate in synchronism with pusher elements 21 to engage and move each carton through the mechanism while folding and sealing the tabs. Each set includes a first tab folder 32, a second tab folder 33 and a third tab folder 34. The folders 32, 34 are used alternately to fold the front tab 13 on cartons of differing lengths. The folder 33 is used to fold the back tab 14 on each carton. Resilient compressors 35 are fixed on transverse rigid bars 36 spanning the chains 30 to exert a vertical pressure along the seam joining the top wall sections 12 during the folding of tabs 13, 14 to assure proper sealing of both the top wall and end tabs of each carton as it progresses through the mechanism.

The front folders 32, 34 and the rear folder 33 are basically similar and common reference numerals are used in the drawings to indicate the elements presented therein. Each folder is mounted to the conveyor chains 30 by a transverse folder mount 37. A transverse shaft 38 extending across the folder mount 37 pivotally supports a folding element 40 beneath the lower working flights of the chains 30. The element 40 faces inwardly toward the carton engaged by it. Each folding element 40 is movable between a lowered position parallel to the end wall of a carton, in which it abuts a tab folded against the carton, and a raised position clear of a carton moving along the carton path as guided by the roller bed 20 and conveyors 18. A perpendicular element 39 cooperates with the element 40 to assure perpendicular bending of each tab. The folding elements 39, 40 have a set of crank arms 41 fixed to them at the respective ends of shaft 38. The crank arms 41 pivot about the axis of shaft 38. Each mounts a roller cam follower 42 that protrudes outwardly to one side of the assembly.

Figure 5:
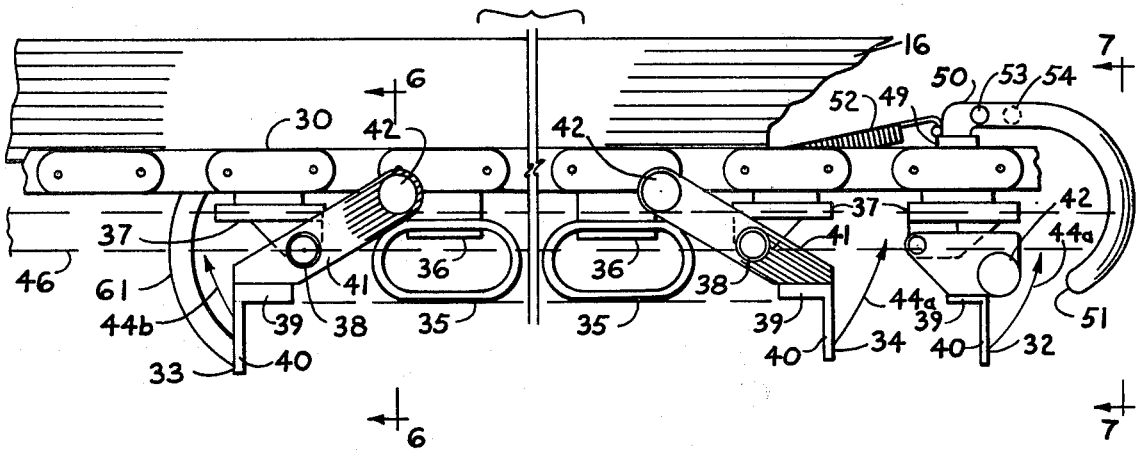
FIG. 5 is an enlarged fragmentary sectional view taken along line 5—5 in FIG. 3.
Figure 7:
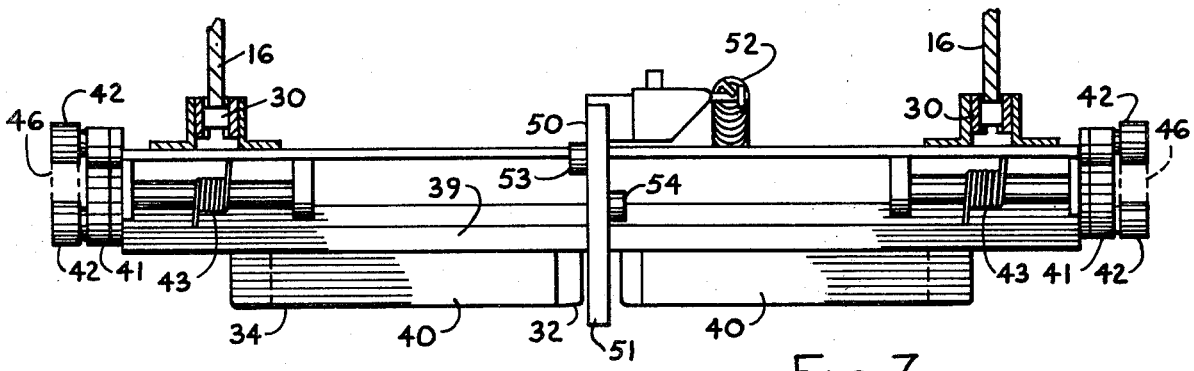
FIG. 7 is a sectional view taken along line 7—7 in FIG. 5.
Figure 8:
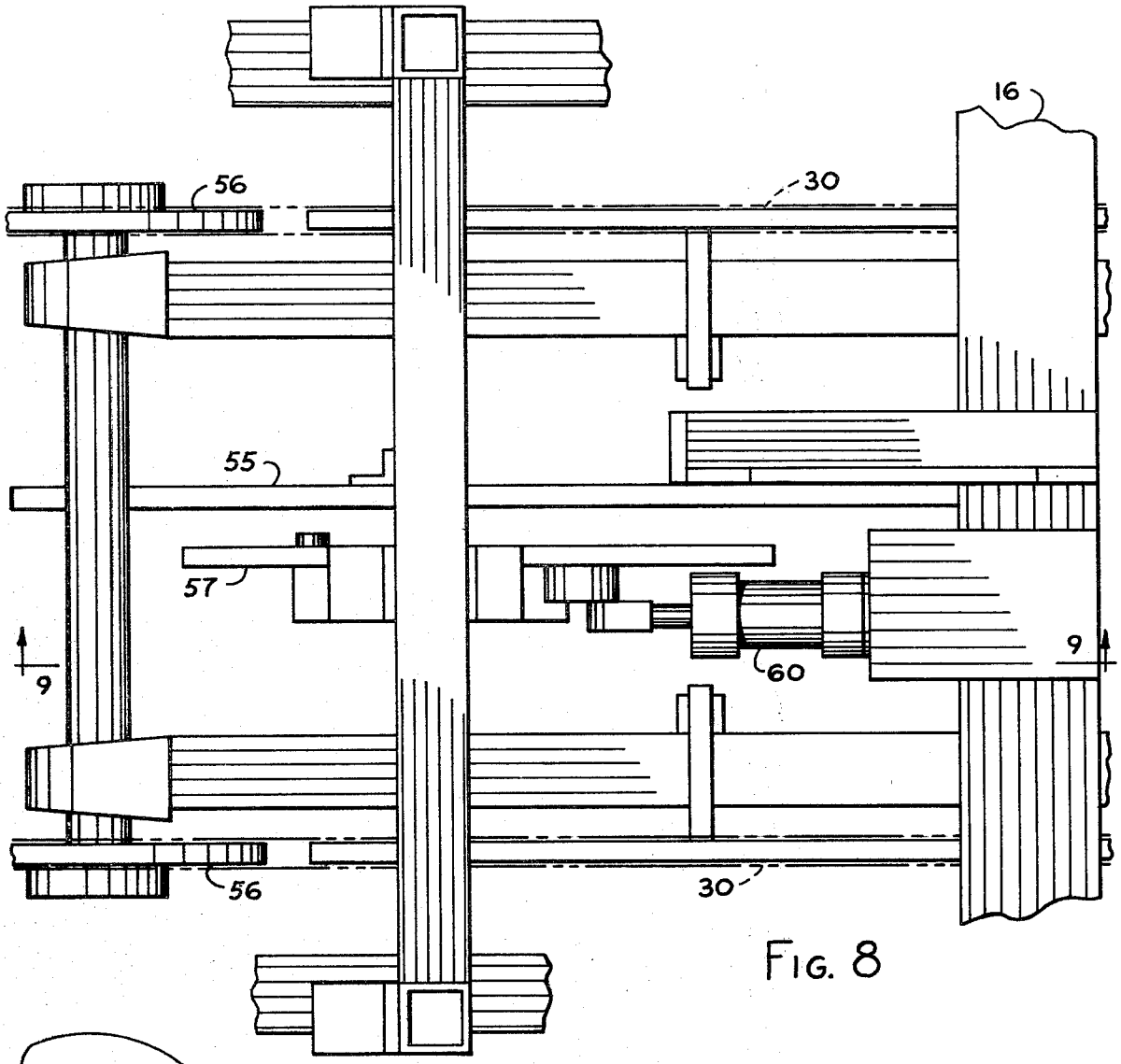
FIG. 8 is an enlarged plan view taken along line 8—8 in FIG. 4.

The folding elements 39, 40 are yieldably urged to their raised positions by torsion springs 43 wrapped about shaft 38 operatively engaged between elements 39, 40 and the folder mount 37 (FIG. 7). As seen in FIG. 5, the front folders 32, 34 are yieldably urged in counterclockwise directions indicated by arrows **44*a*. The back folder 33 is urged oppositely in a clockwise direction indicated by arrow 44*b***.

The cam followers 42 are adapted to engage elongated cam guides 46 extending along each side of framework 16 adjacent to the lower working flights of the conveyor chains 30. It is shown in phantom lines in FIG. 5. As can be seen in FIG. 5, the tab folder 32 is lowered by engagement with the lower surface of the cam guide 46, while the folders 33 and 34 are lowered by engagement along the upper surfaces of the guides 46. The choice involved is effected by a movable leading cam 47 (FIG. 4B) at the upstream end of each cam guide 46. The cams 47 pivot about a transverse axis to raise or lower their respective outer ends so as to properly engage the selected cam followers on the folders 32, 33 and 34. They are shifted vertically by cylinder assemblies 48 connected between them and the supporting framework 16. Each cam guide 46 extends longitudinally along framework 16 from a location spaced downstream from the infeed ends of conveyor chains 30 a distance less than the longitudinal dimensions of a carton to a location adjacent their discharge ends.

When the cartons are filled with bulk materials, such as meat, the load within the cartons sometimes tends to cause the upper carton walls to bulge outwardly, particularly at their center portions. If not corrected, this would tend to improperly locate end walls 10, 11 relative to the folded tabs 13, 14. For this reason, the disclosed mechanism further includes forward and rear kicker elements 50 and 61 which cooperatively push inward along the upper center portions of the front and back end walls 10, 11 respectively.

Each kicker element 50 comprises an elongated arcuate rigid member having an outer end designated by the numeral 51. It is the outer end 51 that actually contacts the exterior central portion of the front end wall 10 of a carton to urge it inwardly and correct any deformations in that area due to the load within the carton. Each forward kicker element 50 is pivotally connected at its base about a transverse axis on a mount 49 fixed to the upper surface of the front folder mount 37 in each set of folders. The forward kicker elements 50 are biased by tension springs 52 to a raised position clear of the path of cartons beneath them along the working flights of the conveyor chains 30.

Because the single forward kicker element 50 is used to compress loads within cartons of two different lengths, a pair of cam followers 53, 54 are mounted to each element 50. The cam follower 53 is used to compress longer cartons and the cam follower 54 is used to compress shorter cartons.

Figure 6:
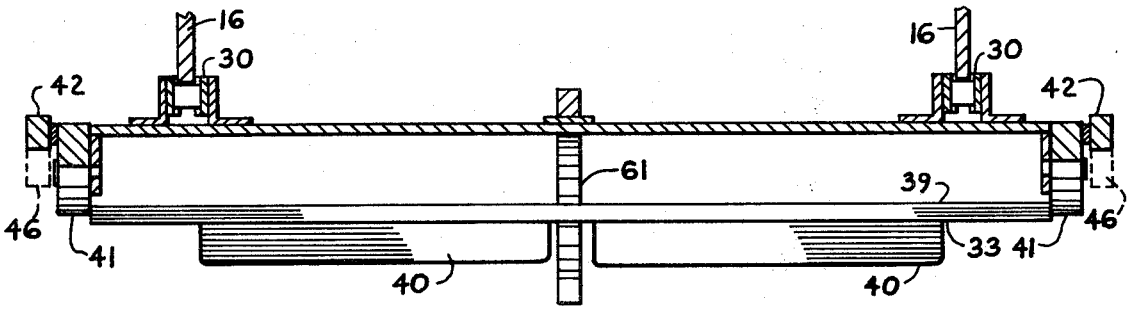
FIG. 6 is a sectional view taken along line 6—6 in FIG. 5.
Figure 9:
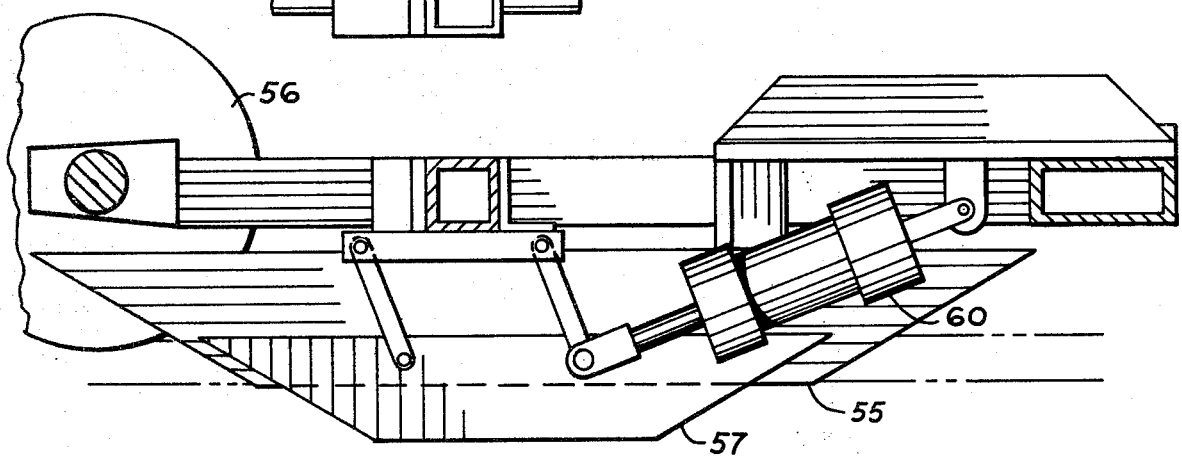
FIG. 9 is a sectional view taken along line 9—9 in FIG. 8.
Figure 10:
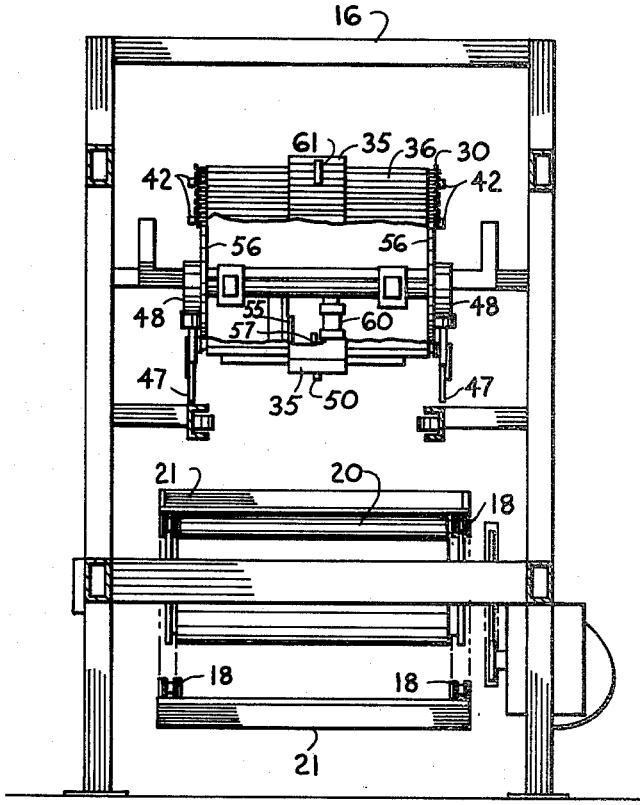
FIG. 10 is an enlarged sectional view taken along line 10—10 in FIG. 3.

Cam follower 53 rides beneath a cam plate 55, best seen in FIGS. 6 and 9. Cam plate 55 is fixed to the framework 16. Its upstream end is slightly upstream from the nose of the cam 47 that controls operation of the front folders. In this manner, the kicker element 50 is actuated against a carton end wall 10 slightly prior to the folding of the tab 13 by the first folder 32.

When a shorter carton is being folded and sealed, the forward kicker element 50 is extended further rearward (opposite to the carton movement direction) by a movable cam plate 57 supported on framework 16 by parallel arms 61. The cam plate 57 is moved between an inoperative raised position and an operative lowered position by a cylinder 60. Its leading edge also is upstream from the nose of cam 47 for the same purpose.

The back end wall 11 is engaged by a rear kicker element 61 similar in structure to kicker element 50, but fixed to the center of the rear folder mount 37 in each set of folders. It is moved into proper position against the back end wall of each carton as the supporting conveyor chains 30 pass downwardly over the upstream sprockets 56 that support them at their infeed end.

Figure 11:
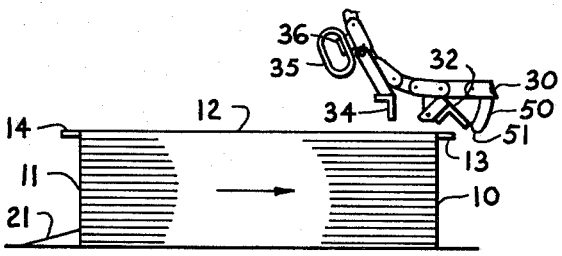
FIGS. 11 through 13 are schematic views showing the folding of the tabs on a longer carton.
Figure 12:
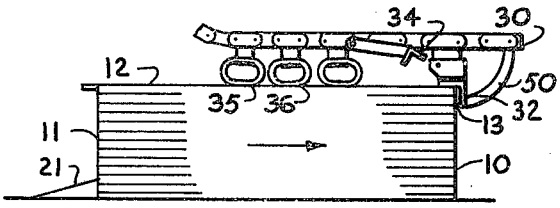
Figure 13:
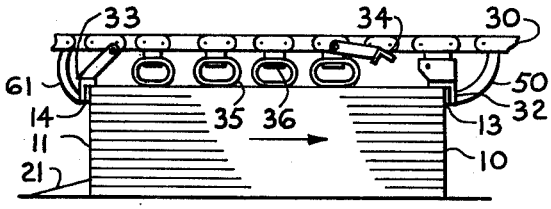
Figure 14:
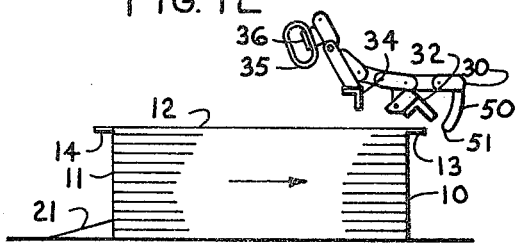
FIGS. 14 through 16 are schematic views showing the folding of tabs on a shorter carton.
Figure 15:
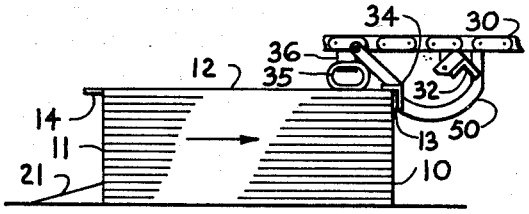
Figure 16:
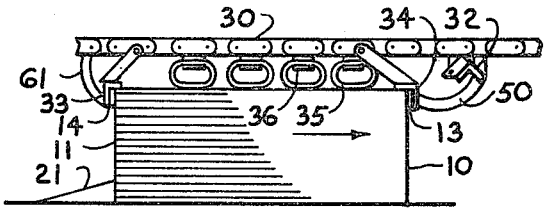

FIGS. 11 through 13 illustrate schematically the sequence of events that occur during the folding of the end flaps on a longer carton, where the folder 34 is inoperative and the cam followers 42 on the folder 32 ride along the underside of the cam guide 46 while the cam followers 42 on the folders 33 ride on its upper surface. This requires shifting of the leading cam 47 between the two cam followers. In the case of shorter cartons as shown in FIGS. 14 through 16, the leading cam 47 remains in one position during passage of a carton in order that both sets of cam followers 42 controlling the folders 33 and 34 can ride along the upper surfaces of the cam guides 46. This particular arrangement is designed for installations where there is a preponderance of shorter cartons. However, the positions of the cam followers 42 relative to the pivot shafts 38 can be reversed to design the machinery to handle a different mix of carton sizes.

This arrangement requires some type of conventional sensing system, such as a photoelectric cell, to detect the length of each carton prior to its entrance beneath the conveyor chains 30. Depending upon the sensed length of the carton, the cylinders 48 and 60 are set simultaneously to arrange the leading cam 47 and the movable cam plate 57 so as to properly move the tap folders and kicker elements as the carton passes under the conveyor.

The elements 39 and 40 remain in engagement with the tabs 13, 14 as the carton moves from the infeed end of the conveyor to its discharge end. The time involved must be sufficient to insure proper sealing of the adhesive applied to the tabs.

Were the mechanism to be designed for use in handling cartons of a single length, the second set of tab folders 33 would be eliminated, along with the use of the movable cam plate 57 for the kicker elements 50.

Other modifications might be made in the basic structure without deviating from the concepts embodied in this disclosure. For this reason, only the following claims are intended as definitions of the disclosed invention.

Having described my invention, I claim:

1. A mechanism for completing the folding of a carton having:

a) oppositely facing front and back end walls spaced longitudinally from one another;

b) a third wall having opposite longitudinal ends overlapping the separation between corresponding transverse edges of the first and second end walls; and c) first and second foldable tabs formed integrally across the third wall at the respective longitudinal ends thereof, said tabs overlying and projecting outward beyond the respective front and back end walls for foldable engagement with the respective exterior surfaces thereof;

said mechanism comprising:

a framework;

guide means on said framework for supporting a carton for movement in a path parallel to the longitudinal dimension of said third wall;

carton engaging means on said framework for imparting movement to a carton along said path;

conveyor means movably mounted on said framework and located adjacent said guide means and having a working flight extending between opposite infeed and discharge ends thereof; said working flight being arranged parallel to said path;

means on said framework for powering said carton engaging means and conveyor means for continuous synchronous movement of a carton along said path while traversing the flight of said conveyor means;

said conveyor means comprising:

a) first transversely oriented tab folding means on the conveyor working flight;

b) operating means on said framework located between the infeed and discharge ends of the working flight for engagement with said tab folding means for causing it to fold and maintain said first tab against the exterior surface of said front end wall as the carton is moved continuously along the working flight of said conveyor means by said carton engaging means; and c) second transversely oriented tab folding means on the conveyor working flight and for folding and maintaining said second tab against the exterior surface of said back end wall as the carton is moved continuously along the working flight of said conveyor means by said carton engaging means.

2. A mechanism as set out in claim 1 wherein said first tab folding means comprises:

a transverse member facing rearwardly with respect to the direction of movement of said conveyor means;

pivot means on the conveyor means movably mounting said member about a transverse axis for motion along the conveyor working flight between a lowered position parallel to the front end wall of a carton and in abutment with said first tab thereof, and a raised position clear of a carton moving along said guide means.

3. A mechanism as set out in claim 1 wherein said first tab folding means comprises:

a transverse folding member facing rearwardly with respect to the direction of movement of said conveyor means;

pivot means on the conveyor means movably mounting said member about a transverse axis for motion along the conveyor working flight between a lowered position parallel to the front end wall of a carton and in abutment with said first tab thereof, and a raised position clear of a carton moving along said guide means; and biasing means on said conveyor means for urging said member to its raised position.

4. A mechanism as set out in claim 1 wherein said first tab folding means comprises:

a transverse folding member facing rearwardly with respect to the direction of movement of said conveyor means;

pivot means on the conveyor means movably mounting said member about a transverse axis for motion along the conveyor working flight between a lowered position parallel to the front end wall of a carton and in abutment with said first tab thereof, and a raised position clear of a carton moving along said guide means; and biasing means on said conveyor means for urging said member to its raised position;

said operating means comprising a cam follower mounted to said transverse folding member and a complementary cam member on said framework alongside the working flight of said conveyor means for moving said transverse folding member to its lowered position in opposition to said biasing means.

5. The mechanism set out in claim 4 wherein said cam member extends from a location spaced downstream from the infeed end of said conveyor means a distance less than the longitudinal dimensions of a carton to a location adjacent the discharge end of said conveyor means.

6. The mechanism set out in claim 1 wherein said second tab folding means comprises:

a transverse member facing forwardly with respect to the direction of movement of said conveyor means; and pivot means on the conveyor means movably mounting said member about a transverse axis for motion along the conveyor working flight between a lowered position parallel to the back end wall of a carton and in abutment with said second tab thereof, and a raised position clear of a carton moving along said guide means.

7. A mechanism as set out in claim 6 wherein said first tab folding means comprises:

a transverse folding member facing rearwardly with respect to the direction of movement of said conveyor means;

pivot means on the conveyor means movably mounting said member about a transverse axis for motion along the conveyor working flight between a lowered position parallel to the front end wall of a carton and in abutment with said first tab thereof, and a raised position clear of a carton moving along said guide means; and biasing means on said conveyor means for urging said member to its raised position.

8. A mechanism as set out in claim 6 wherein said first tab folding means comprises:

a transverse folding member facing rearwardly with respect to the direction of movement of said conveyor means;

pivot means on the conveyor means movably mounting said member about a transverse axis for motion along the conveyor working flight between a lowered position parallel to the front end wall of a carton and in abutment with said first tab thereof, and a raised position clear of a carton moving along said guide means; and biasing means on said conveyor means for urging said member to its raised position;

said operating means comprising a cam follower mounted to said transverse folding member and a complementary cam member on said framework alongside the working flight of said conveyor means for moving said transverse folding member to its lowered position in opposition to said biasing means.

9. The mechanism set out in claim 8 wherein said cam member extends from a location spaced downstream from the infeed end of said conveyor means a distance less than the longitudinal dimensions of a carton to a location adjacent the discharge end of said conveyor means.

10. A mechanism as set out in claim 1 further comprising: kicker means mounted to said conveyor means along the center line thereof for movable engagement with a portion of each end wall during the folding thereof by said first and second folding means respectively.

11. A mechanism as set out in claim 1 further comprising:

third transversely oriented tab folding means on the conveyor working flight intermediate said first and second tab folding means for folding and maintaining a tab against the exterior surface of the end wall of a carton having a longitudinal dimension less than the separation of said first and second tab folding means.

* * * * *